US008369188B2

(12) United States Patent
Karapatis et al.

(10) Patent No.: US 8,369,188 B2
(45) Date of Patent: Feb. 5, 2013

(54) STRIKING WATCH WITH AN ACOUSTIC MEMBRANE

(75) Inventors: Nakis Karapatis, Premier (CH); Jérôme Favre, Les Bioux (CH); Lucien Germond, Grandson (CH)

(73) Assignee: Montres Breguet SA, L'Abbaye (CH)

( * ) Notice: Subject to any disclaimer, the term of this patent is extended or adjusted under 35 U.S.C. 154(b) by 163 days.

(21) Appl. No.: 13/030,420

(22) Filed: Feb. 18, 2011

(65) Prior Publication Data

US 2011/0228647 A1 Sep. 22, 2011

(30) Foreign Application Priority Data

Mar. 16, 2010 (EP) ..... 10156623

(51) Int. Cl.
*G04B 23/02* (2006.01)

(52) U.S. Cl. ..... 368/243; 368/272

(58) Field of Classification Search ..... 368/244, 368/327, 243, 272–273
See application file for complete search history.

(56) References Cited

U.S. PATENT DOCUMENTS

| | | | | |
|---|---|---|---|---|
| 8,050,149 | B2 * | 11/2011 | Karapatis et al. | 368/244 |
| 2008/0041213 | A1 * | 2/2008 | Richter | 84/297 R |
| 2008/0118759 | A1 * | 5/2008 | Korpi | 428/457 |
| 2009/0272246 | A1 * | 11/2009 | Richter | 84/297 S |
| 2011/0056301 | A1 * | 3/2011 | Winkler et al. | 73/714 |
| 2012/0140602 | A1 * | 6/2012 | Favre et al. | 368/272 |
| 2012/0140603 | A1 * | 6/2012 | Sarchi et al. | 368/272 |

FOREIGN PATENT DOCUMENTS

| | | | |
|---|---|---|---|
| CH | 263861 | A | 9/1949 |
| CH | 319298 | A | 2/1957 |
| EP | 1 795 978 | A2 | 6/2007 |
| EP | 1 879 086 | A1 | 1/2008 |
| EP | 2 107 436 | A2 | 10/2009 |
| EP | 2 107 437 | A2 | 10/2009 |
| FR | 1 134 685 | A | 4/1957 |
| JP | 55-046165 | A | 3/1980 |
| WO | 2009/132983 | A1 | 11/2009 |

* cited by examiner

*Primary Examiner* — Sean Kayes
(74) *Attorney, Agent, or Firm* — Sughrue Mion, PLLC

(57) ABSTRACT

The striking watch (1) includes a watch case, which is formed of a middle part (4) and a back cover (5) removably secured to the middle part, and a crystal (2) that closes the case in a sealed manner. A watch movement (20) is held inside the watch case on a plate (14). The watch movement is provided with a striking mechanism able to be actuated at determined times to produce a sound. At least one acoustic membrane (10) is arranged between the back cover (5) which includes at least one lateral aperture (6) and the plate (14) of the watch movement. This acoustic membrane is made of amorphous metal or metallic glass to radiate the sound produced by the striking mechanism towards the exterior of the case.

12 Claims, 1 Drawing Sheet

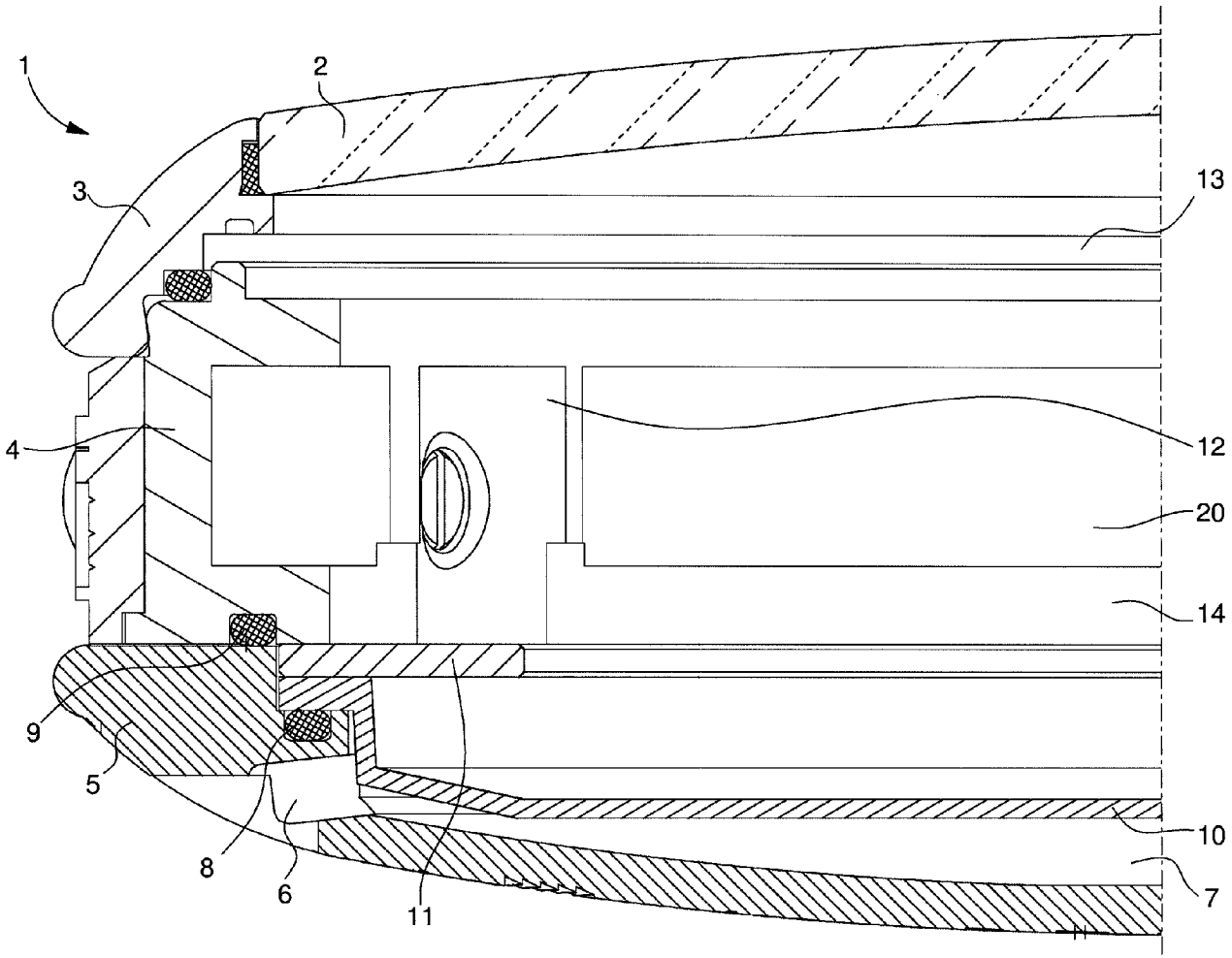
1
2
3
4
5
6
7
8
9
10
11
12
13
14
20

STRIKING WATCH WITH AN ACOUSTIC MEMBRANE

This application claims priority from European Patent Application No. 10156623.0 filed Mar. 16, 2010, the entire disclosure of which is incorporated herein by reference.

FIELD OF THE INVENTION

The invention concerns a striking watch, which is provided with an acoustic membrane. The watch includes a watch case essentially formed of a middle part and a back cover removably secured in a sealed manner to the middle part. A crystal is arranged on the opposite side of the middle part to close said case in a sealed manner. A timepiece movement is held inside the watch case and provided with a striking mechanism that can be actuated at determined times to produce a sound. At least one acoustic membrane is connected to the case to radiate the sound produced by the striking mechanism towards the exterior of the case.

BACKGROUND OF THE INVENTION

Within the field of watch-making, a conventional architecture is used to make movements, which may also include striking mechanisms. This striking mechanism can be actuated at well defined times to indicate a programmed alarm or minute repeaters. In a conventional embodiment of a striking watch, the striking mechanism may include a gong. The gong is generally a metal wire of circular shape, which surrounds part of the watch movement inside a watch frame. The gong is fixed to a gong-carrier, which is integral with a bottom plate of the watch. The gong vibration is generated by the impact of at least one hammer against the gong at determined times.

In the case of a striking watch, such as a musical watch, the sound is produced by the vibrating tongues of a pin-barrel. The pin-barrel tongues are made together with a heel of the pin-barrel, which is mounted on the watch plate. For producing music, for example at programmed time periods, the pin-barrel tongues are raised and then released by pins secured to a rotating disc or cylinder. Each tongue can therefore bend via the action of a corresponding pin of the cylinder or disc, and as soon as said tongue is released, it oscillates mainly at its first natural frequency. The musical pin-barrel is enclosed in the watch case. Consequently, the vibrations generated by the actuated tongues are transmitted to the external parts of the watch.

The external parts of the watch are, for example, the middle part, the bezel, the crystal or the back cover of the case. When a sound is produced either by a gong struck by a hammer, or by one or more vibrating pin-barrel tongues, these external parts are capable of radiating the produced sound into the air. In a conventional striking watch, the acoustic efficiency, based on the complex vibro-acoustic transduction of the external parts, is low. In order to improve and increase the acoustic level perceived by the user of the striking watch, the material, geometry and boundary conditions of said external parts must be taken into account. The configurations of these external parts are also dependent upon the aesthetic appearance of the watch and operating stresses, which may limit adaptation possibilities.

It is known in watchmaking technology to use an acoustic type membrane, which is dedicated to vibro-acoustic transduction, in a watch and particularly an electronic watch. To activate this type of membrane in an electronic watch, a piezoelectric element is, for example, placed on the membrane to cause it to vibrate. To prevent the acoustic radiation from the membrane from being lost in the watch, which must be sealed, a double back cover can be provided for the watch case, which must be open towards the exterior. In such case, the back cover of the watch case has one or more apertures for the transmission of sound from the vibrating membrane.

With this type of design for an electronic watch with an acoustic membrane, problems often arise relating to the sealing and corrosion of said membrane. The first natural vibration frequency of this membrane, which is the efficient radiation mode, is within the useful acoustic frequency band, whereas its second natural frequency, which is an inefficient mode, must if possible be outside this audible band. Since the membrane is usually made of steel, the first and second natural vibration frequencies do not fulfil the aforementioned conditions in an optimum manner. Moreover, rapid damping is observed, which is a drawback.

In a standard striking watch, which is, for example, fitted with an acoustic membrane, the membrane is sandwiched between part of the middle case and the back cover of the watch. In the case of a luxury watch, the back cover may be made of a precious material, such as gold. A difference in electrochemical potential may occur on contact between the membrane, which is generally made of steel, and the gold back cover, especially in a humid environment. This is liable to contribute to corrosion of said membrane where it is in contact with the gold back cover, which is another drawback.

SUMMARY OF THE INVENTION

It is thus an object of the invention to overcome the drawbacks of the state of the art by providing a striking watch, which is provided with an acoustic membrane, to obtain a high level of acoustic efficiency during operation of a striking mechanism in the watch case.

The invention therefore concerns a striking watch including a watch case, which includes a middle part and a back cover removably secured in a sealed manner to the middle part, a crystal closing the case in a sealed manner, a watch movement held inside the watch case and provided with a striking mechanism able to be actuated at determined times to produce a sound, and at least one acoustic membrane connected to the case to radiate the sound produced by the striking mechanism towards the exterior of the case, wherein the acoustic membrane is made of amorphous metal, and wherein the amorphous metal is a titanium, zirconium and beryllium based metal alloy or a metal alloy that is formed of 57.5% platinum, 14.7% copper, 5.3% nickel and 22.5% phosphorus.

Specific embodiments of the striking watch as defined below.

One advantage of the striking watch according to this invention lies in the fact that the acoustic membrane in the watch case is made of an amorphous metal or metallic glass. In these conditions, when the striking mechanism produces a sound or a succession of musical notes, the acoustic membrane is capable of vibrating with a first natural frequency within the useful acoustic band between 1 and 4 kHz. The second natural vibration frequency, which is generally inefficient in terms of acoustic radiation, is advantageously above 4 kHz with this amorphous metal membrane. Consequently, it does not affect the acoustic radiation of the membrane at its first natural frequency. It is physical properties, such as density and the Young's modulus of the amorphous metal, which allow the desired natural frequencies to be obtained. Owing to this amorphous metal membrane, a very low level of damping is observed, which provides a very high level of acoustic efficiency.

Advantageously, the acoustic membrane is clamped in a sealed manner on the edge thereof between a connecting part linked to the watch plate and the back cover of the watch case, thereby forming a double back cover. One or several apertures are provided through the back cover for the acoustic radiation from the acoustic membrane. With a membrane made of corrosion resistant amorphous metal, there is, in theory, no difference in electrochemical potential upon the contact between the membrane with the back cover of the case, even if the back cover is made of gold. No corrosion is therefore observed even in a humid environment. Moreover, it is less expensive to machine an amorphous metal membrane than a steel or titanium membrane. This also enables parts with complex shapes to be made, which can give the striking watch a high tech appearance.

BRIEF DESCRIPTION OF THE DRAWING

The objects, advantages and features of the striking watch will appear more clearly in the following description on the basis of at least one non-limiting embodiment illustrated by the drawing, in which:

FIG. 1 shows a simplified partial cross-section of a striking watch provided with an acoustic membrane according to the invention.

DETAILED DESCRIPTION OF THE INVENTION

In the following description, all those parts of the striking watch that are well known to those skilled in the art in this technical field will be described only in a simplified manner.

FIG. 1 thus shows a simplified partial cross-section of a striking watch 1 with an acoustic membrane 10. The watch includes a watch case, which is essentially formed of a middle part 4 on one side of which a bezel 3 is secured in a sealed manner and on the opposite side of which there is a back cover 5. Back cover 5 is removably mounted by known means on middle part 4 with a sealing gasket 9. A watch crystal 2 is secured notably to bezel 3 to close the watch case in a sealed manner. A dial 13 is held on the edge of the middle part and arranged below watch crystal 2. In the case of a striking watch 1, time indicating hands, which are not shown, are provided on the dial, which generally carries hour symbols on the periphery thereof.

Striking watch 1 also includes a watch movement 20, which is generally mounted on a plate 14. An edge part 12 is secured to plate 14, which defines a watch frame. Usually, both plate 14 and the edge part are made of a metallic material.

The watch movement includes a striking mechanism which is not shown. This striking mechanism may include at least one gong mounted on a gong-carrier integral with plate 14, and at least one rotatably mounted hammer on the plate for striking said gong at determined times. The generally circular gong surrounds the various parts of the watch movement. This striking mechanism is provided for indicating a programmed alarm time or minute repeaters.

In a more elaborate musical watch embodiment, the striking mechanism may include a pin-barrel with a set of tongues connected to a heel, which is secured to plate 14. The sound or series of musical notes are produced by the vibrating tongues of the pin-barrel. Each tongue is configured to produce a particular note. To produce music, for example at programmed times, the pin-barrel tongues are raised and then released by pins integral with a rotating disc or cylinder on plate 14. Each actuated tongue mainly oscillates at its first natural frequency. The vibrations generated by the actuated tongues are transmitted to the external parts of the watch, which must allow the sound produced by each vibrating tongue to radiate acoustically.

Striking watch 1 essentially includes an acoustic membrane 10 for improving the acoustic efficiency of the sound produced by the striking mechanism. This acoustic membrane is made of an amorphous metal or metallic glass, which may be a corrosion resistant material. The thickness of this membrane may be less than or equal to 1 mm. In this embodiment, the acoustic membrane 10 is a single dome-shaped part, the top edge of which is mounted, in a sealed manner via an annular gasket 8, on an inner annular edge of back cover 5 of the case. The diameter of this dome, which may be the same as the diameter of watch glass 2, may be between 20 and 40 mm. An annular shaped support 11 supports plate 14 on one side with edge part 12 and rests on the top edge of acoustic membrane 10. When middle part 4 is secured to back cover 5 of the watch case, support 11 and the peripheral edge of acoustic membrane 10 are clamped between middle part 4 and the edge of back cover 5.

The central part of the acoustic membrane is not in contact with support 11 and the inner surface of back cover 5. Consequently, a sufficient space 7 is provided in the case for the acoustic membrane to be able to vibrate freely or radiate acoustically. Acoustic membrane 10 and back cover 5 thus together form a double back cover. One or several apertures 6 are also provided laterally through back cover 5 to allow the acoustic membrane to radiate the sound produced by the striking mechanism towards the exterior.

During operation of the striking mechanism, the sound produced by said striking mechanism is transmitted straight to the acoustic membrane to make it vibrate. Connecting parts 11, 12 and 14 also transmit vibration to the acoustic membrane at the edge thereof. Since the acoustic membrane is made of amorphous metal, it is capable of vibrating at a first natural frequency within the useful acoustic band between 1 and 4 kHz. The second natural vibration frequency is, however, above 4 kHz. This is very advantageous given that the second vibration frequency is often sound destructive. These desired natural acoustic vibration frequencies of the amorphous metal membrane are dependent upon physical properties, such as density and the Young's modulus. Moreover, with this type of amorphous metal membrane, a very low level of damping is observed which provides a very high level of acoustic efficiency for the acoustic membrane.

It is to be noted that this amorphous metal or metallic glass acoustic membrane can be fabricated less expensively than a conventional steel or titanium membrane. It may for example be fabricated from the amorphous metal in the molten state, followed by rapid hardening. Owing to the fact that this amorphous metal membrane is corrosion resistant, it can be mounted on a back cover, for example made of precious metal, such as gold. There is no difference in electrochemical potential observed even in a humid environment, which means that no corrosion occurs on contact between membrane 10 and back cover 5.

The advantage of using an amorphous metal membrane arises from the fact that during manufacture, the atoms that form said amorphous metal are not arranged in any particular structure, which is different from a crystalline structure. The amorphous metal differs in that it has a higher limit of elasticity, for example two times higher, than that of a conventional crystalline material. The acoustic membrane made with amorphous metal can thus undergo greater stress before reaching its limit of elasticity. This also leads to a lower level of damping in the vibrating membrane.

This metallic glass or amorphous metal can be for example a titanium, zirconium and beryllium based metal alloy. Thus, by way of more specific example, the amorphous metal alloy may include 41% zirconium, 14% titanium, 12% copper, 10% nickel and 23% beryllium. The Young's modulus of this alloy is 105 GPa and the limit of elasticity is 1.9 GPa. The amorphous metal alloy may also be formed of 57.5% platinum, 14.7% copper, 5.3% nickel and 22.5% phosphorus. In such case the Young's modulus is 98 GPA and the limit of elasticity is 1.4 GPa.

For other example embodiments of parts with amorphous metal, the reader may refer to the method defined in WO Patent Application Nos. 2009/132983 or 03/023081.

From the description that has just been given, several variants of the striking watch provided with an acoustic membrane can be devised by those skilled in the art without departing from the scope of the invention defined by the claims. This amorphous metal membrane can be located in the middle part of a watch case with an aperture through the middle part for the acoustic radiation of the vibrating acoustic membrane. The acoustic membrane may also be located on an external part of the watch case, but arranged on at least one aperture in the case so that the sound produced by the striking mechanism can cause the membrane to vibrate. Several acoustic membranes may be provided, arranged at several places inside the watch case or superposed on each other. These acoustic membranes may be made with the same amorphous metal or with different amorphous metals. Circular ribs may also be provided to make said acoustic membrane more rigid and to alter the first natural vibration frequency.

What is claimed is:

1. The striking watch including a watch case, which includes a middle part and a back cover removably secured in a sealed manner to the middle part, a crystal closing the case in a sealed manner, a watch movement held inside the watch case and provided with a striking mechanism able to be actuated at determined times to produce a sound, and at least one acoustic membrane connected to the case to radiate the sound produced by the striking mechanism towards the exterior of the case, wherein the acoustic membrane is made of amorphous metal, and wherein the amorphous metal is a metal alloy which includes 41% zirconium, 14% titanium, 12% copper, 10% nickel and 23% beryllium or a metal alloy that is formed of 57.5% platinum, 14.7% copper, 5.3% nickel and 22.5% phosphorus.

2. A striking watch according to claim 1, wherein the acoustic membrane is arranged inside the watch case between the back cover of the case and a plate on which the watch movement with the striking work is mounted.

3. A striking watch according to claim 1, wherein the acoustic membrane is held on an inner edge of the back cover of the case and one part of the middle part.

4. A striking watch according to claim 1, wherein the plate, on which the watch movement is mounted, is arranged on a support and wherein the periphery of the acoustic membrane is clamped with the periphery of the support between the middle part and an inner edge of the back cover of the case.

5. A striking watch according to claim 4, wherein the acoustic membrane has the shape of a dome, whose top edge is clamped with the annular support between the middle part and an inner annular edge of the back cover of the case, an annular sealing gasket being placed between the edge of the back cover and the annular edge of the membrane, and wherein a central part of the acoustic membrane is not in contact with the support and an inner surface of the back cover of the case to define a space allowing said membrane to oscillate freely.

6. A striking watch according to claim 4, wherein the plate is connected to an edge piece in order to be mounted on the annular support on the opposite side to the acoustic membrane.

7. A striking watch according to claim 2, wherein the back cover of the case includes at least one lateral aperture to allow the vibrating acoustic membrane to produce an acoustic radiation towards the exterior of the watch case.

8. A striking watch according to claim 1, wherein the composition of the metal alloy is determined such that the first natural vibration frequency of the acoustic membrane is between 1 and 4 kHz, whereas the second natural vibration frequency is above 4 kHz.

9. A striking watch according to claim 1, wherein the diameter of the dome-shaped acoustic membrane, arranged on an edge of the back cover of the watch case, is substantially similar to the diameter of the crystal and the thickness thereof is less than or equal to 1 mm, and wherein the crystal closes the watch case in a sealed manner via a bezel of the case, to which it is secured.

10. A striking watch according to claim 1, wherein the acoustic membrane, arranged inside the watch case, includes several circular ribs for adapting the first vibration frequency.

11. A striking watch according to claim 1, wherein several acoustic membranes are connected to the watch case and set apart from each other or superposed on each other.

12. A striking watch according to claim 11, wherein each membrane is formed of a different amorphous metal alloy.

* * * * *